United States Patent [19]

Matsuda

[11] Patent Number: 4,482,256

[45] Date of Patent: Nov. 13, 1984

[54] TOY WATCH

[75] Inventor: Takashi Matsuda, Tokyo, Japan

[73] Assignee: Takaro Co., Ltd., Tokyo, Japan

[21] Appl. No.: 557,602

[22] Filed: Dec. 2, 1983

[30] Foreign Application Priority Data

Jun. 4, 1983 [JP] Japan ..... 58-85426

[51] Int. Cl.[3] ..... G04B 47/00; G04B 45/00; A63H 13/00

[52] U.S. Cl. ..... 368/10; 368/45; 368/277

[58] Field of Search ..... 368/10, 45, 88, 276–278, 368/316–317; 46/22, 153, 161, 163

[56] References Cited

U.S. PATENT DOCUMENTS

| | | | |
|---|---|---|---|
| D. 261,532 | 10/1981 | Tabata . | |
| D. 272,933 | 3/1984 | Murakami . | |
| 3,277,646 | 10/1966 | Howard, Sr. . | |
| 4,170,840 | 10/1979 | Ogawa . | |
| 4,203,248 | 5/1980 | Tapdrup | 46/22 |
| 4,206,564 | 6/1980 | Ogawa | 46/163 |
| 4,307,459 | 12/1981 | Iwao . | |
| 4,411,097 | 10/1983 | Murakami | 46/161 |
| 4,456,384 | 6/1982 | Murakami . | |

FOREIGN PATENT DOCUMENTS

| | | |
|---|---|---|
| 12681 | 3/1983 | Australia . |
| 12682 | 3/1983 | Australia . |
| 58-16588 | 1/1983 | Japan . |
| 58-18848 | of 1983 | Japan . |

*Primary Examiner*—Vit W. Miska

*Attorney, Agent, or Firm*—Jackson, Jones & Price

[57] ABSTRACT

A compact reconfigurable toy watch assembly which includes a wristband member connected to a body member having an upper body surface with a time display and a robotic humanoid head. A pair of arm members are movably attached to the body member and form either robotic arms or form with the body member a portion of the upper surface of the watch assembly. The arm members also form outer perimetrical sides of the watch assembly when moved adjacent the body member. A pair of leg members are movably attached to the body member and form either robotic legs or, when positioned in a folded configuration adjacent the body member, another portion of the upper watch assembly surface and an outer perimetrical side.

23 Claims, 10 Drawing Figures

TOY WATCH

BACKGROUND OF THE INVENTION

This invention relates to a novel toy functioning as a wrist watch and a toy robotic humanoid at the same time.

A conventional wrist watch is intended originally for timekeeping and time indication only, and even such wrist watch as is particularly provided to cater to infants' or children's application may be not so attractable to maintain a child's interest. Nevertheless, infants and children are prone to obtain a wrist watch of their own to imitate adult persons wearing a wrist watch.

In view of the above circumstances, this invention has been made to provide a toy watch capable of working as a normal wrist watch while worn on the wrist but also capable of serving as a robotic humanoid reconfigured for play when taken off the wrist, thereby encouraging an early nourishment of the infants' or children's awareness of time on the watch.

SUMMARY OF THE INVENTION

This invention is to provide a toy watch comprising a wrist wearing band and a watch assembly installed detachably thereon, wherein the wrist wearing band is provided with a mounting base almost in the middle thereof longitudinally and a stopping means provided on the mounting base, and the watch assembly is provided with a watch body installed detachably on the mounting base through the stopping means. Arms, legs and a head which are coupled to the watch body constitute a robotic humanoid together with the watch body.

More particularly, a compact reconfigurable toy watch assembly is provided which includes a wristband member connected to a body member having an upper body surface with a time display and a robotic humanoid head. A pair of arm members are movably attached to the body member and form either robotic arms or form with the body member a portion of the upper surface of the watch assembly. The arm members also form outer perimetrical sides of the watch assembly when moved adjacent the body member. A pair of leg members are movably attached to the body member and form either robotic legs or, when positioned in a folded configuration adjacent the body member, another portion of the upper watch assembly surface and an outer perimetrical side.

BRIEF DESCRIPTION OF THE DRAWINGS

The drawings represent one preferred embodiment of this invention, wherein.

DETAILED DESCRIPTION OF THE INVENTION

Figure 1:
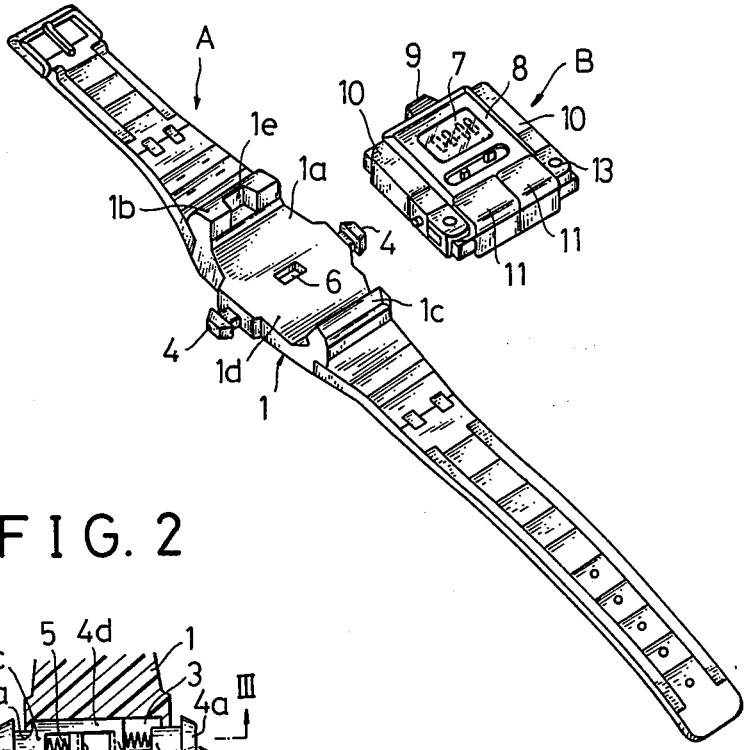
FIG. 1 is a perspective view showing a band and a watch assembly separately from each other.
Figure 2:
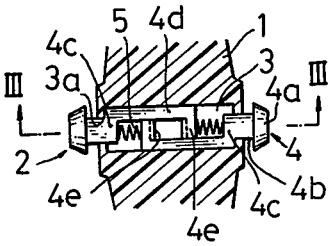
FIG. 2 is a transverse sectional view of a mounting base.

Next, the invention will be described for its one preferred embodiment with reference to the accompanying drawings.

A toy watch given in one embodiment of this invention consists of a wrist wearing band (hereinafter simply called "band") denoted by a character A and a watch assembly denoted by a character B.

The band A is provided with a mounting base 1 in the middle thereof, and a stopping means 2 is provided on the mounting base 1. The mounting base 1 has a flat plate 1*a* and retainers 1*b*, 1*c* erected on both sides vertically of the flat plate 1*a* as illustrated, and a fitting zone 1*d* is formed by the flat plate 1*a* and the retainers 1*b*, 1*c*. A concavity 1*e* ranging to the fitting zone 1*d* is provided at the center of the upper side retainer 1*b*.

The stopping means 2 is constituted as follows. A hole 3 penetrating horizontally as illustrated is formed within the flat plate 1*a*, and symmetrical two operating rods 4 are enclosed in the hole 3 slidably leftward and rightward with one part projected externally from the mounting base 1. Each operating rod 4 has integrally a head 4*a* working as a stopper at the same time on the outer end, a stop member 4*e* on the inner end, and a neck 4*b*, a shoulder 4*c* and a guide member 4*d* between the head 4*a* and the stop member 4*e*. Then, each operating rod 4 has its stop member 4*e* interposed between the stop member 4*e* and the shoulder 4*c* of the other operating rod 4 each other and the neck 4*b* penetrated through an opening 3*a* of the hole 3.

With a coil spring or other spring 5 is interposed, for example, between the stop member 4*e* and the shoulder 4*c* adjacent each other, the two operating rods 4, 4 are energized in the direction where the head 4*a* is separated from a side of the mounting base 1, and thus the shoulder 4*c* is abutted on the inside of an edge of the opening 3*a* to prevent them from coming off. The flat plate 1*a* of the mounting base 1 is provided with a hole 6 penetrating in the front and back direction of the band A at the center, and the stop member 4*e* of the two operating rods 4, 4 fronts on the hole 6.

Thus from pushing the two heads 4*a* projecting on both sides of the mounting base 1 with fingers in the direction opposite each other, the operating rods 4, 4 slide inside along the hole 3 through the guide member 4*d*, and both the stop members 4*e* retreat from the hole 6. In this case, since the head 4*a* extends outward from the neck 4*b*, the head 4*a* contacts with an edge of the opening 3*a* of the hole 3 to work as a stopper.

Figure 4:
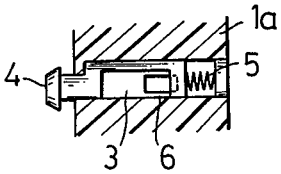
FIG. 4 is a sectional view showing another example of the stopping means.

As illustrated in FIG. 4, the stopping means 2 can also be constituted such that the hole 3 of the mounting base 1 is kept open on one side only to enclose one operating rod 4 therein, and the spring 5 is interposed between the stop member 4*e* and a bottom of the hole 3.

The watch assembly B consists of a watch body 8 provided on its upper body surface with a known time mechanism having a window 7 for digital display of time, a simulated head 9 projected on top of the watch body 8 and coupled rotatably on a shaft of pin 9*a* (FIG. 5), arms 10, 10 coupled to both left and right sides of the watch body 8 rotatably on shafts of pins 10*a*, 10*a*, and legs 11, 11 coupled foldably to a bottom of the watch body 8.

By coupling the arms 10, 10 through shafts having a horizontal axis, i.e. the pins 10*a*, 10*a*, a plane common with the watch body 8 is formed in the state where the arms 10, 10 are kept downward, and the legs 11, 11 are coupled to a frame 14 fixed on the watch body 8 through shafts 12, 12 having a longitudinal axis as illustrated, further an upper thigh 11*a* and a lower thigh 11*b* which constitute each leg 11 are coupled likewise through shafts 13, 13 having a longitudinal axis, and each lower thigh 11*b* is formed by a frame almost U-shaped in section. Thus as illustrated in FIG. 6, the frame 14 and the upper thigh 11*a* are enclosed in the lower thigh 11*b* when the upper thigh 11*a* is raised horizontally and further the lower thigh 11*b* is raised horizontally inside, the lower thigh 11*b* also forms a plane common with the watch body, and thus the watch body 8, the arms 10, 10 and the legs 11 are brought to a form of the watch in one block of approximately a rectangular configuration as shown in FIG. 1. The arms 10, 10 and the legs 11, 11 in combination with the watch body 8 form the upper watch assembly surface when configured to simulate a compact watch assembly. In this position the arms 10, 10 are positioned adjacent the body member 8 as shown in FIG. 1 to form outer perimetrical sides with the body member 8 being positioned between the arm members 10, 10. The leg members 11, 11 have supporting ends that are rotated to abut against each other and the body member 8 to thereby provide another outer perimetrical side. The leg members 11, 11 also form another portion of the upper watch assembly surface.

Figure 3:
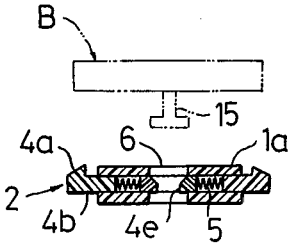
FIG. 3 is a sectional view taken on line III—III of FIG. 2.
Figure 5:
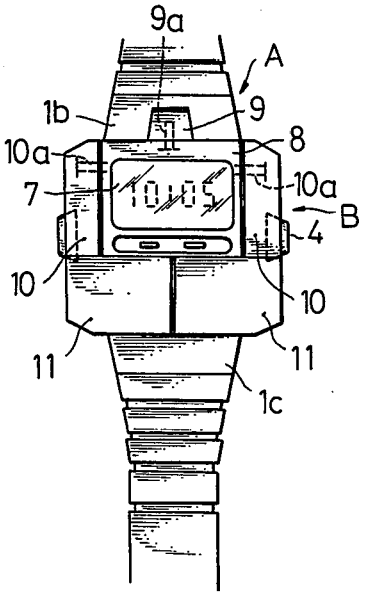
FIG. 5 is a plan view showing a state wherein the watch assembly is installed on the band, FIGS. 6 (*a*) to (*e*) are diagrams showing operations for reconfiguring the watch assembly to a robotic humanoid.
Figure 6A:
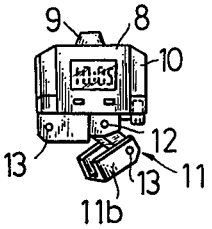
Figure 6B:
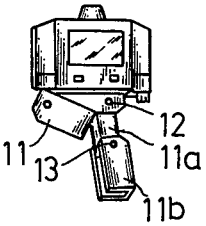
Figure 6C:
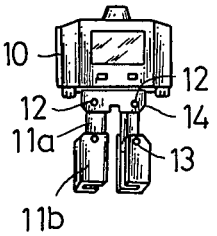
Figure 6D:
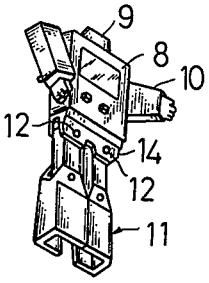
Figure 6E:
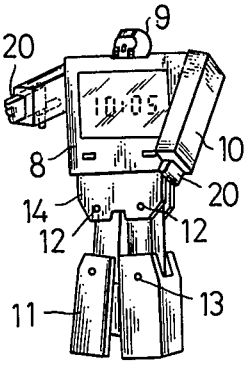

Then, the head of the watch assembly B has a shape and size corresponding to the concavity 1*e* of the retainer 1*b* of the mounting base 1 of the band A and simulates a face on one side or the back, for example, in FIG. 5. Further, a stop projection 15 of an inverted T-shaped in section corresponding to the hole 6 provided at the center of the flat plate 1*a* of the mounting base 1 is provided, as shown in FIG. 3, on the back of the watch body 8.

As illustrated in FIG. 1, the watch assembly B in one block state is kept near to the fitting zone 1*d* of the mounting base 1 of the band A on its back, the head 9 is placed in position correspondingly to the fitting zone 1*d*, and then it is pressed onto the flat plate 1*a* side to insert the stop projection 15 in the hole 6 constituting the stopping means. In this case, since a tip of the stop projection 15 depresses a taper plane formed on the surface of the stop members 4*e*, 4*e* of the operating rods 4, 4, both the operating rods 4, 4 are moved horizontally against the spring 5 to retreat from the hole 6. When the tip of the stop projection 15 passes the stop members 4*e*, 4*e*, the operating rods 4, 4 are reset by the springs 5, 5, therefore the stop projection 15 is held between the stop members 4*e*, 4*e* of both the operating rods 4, 4, and thus the watch assembly B cannot be detached from the band A.

In the state where the watch assembly B is installed on the band A as shown in FIG. 5, it presents a similar surface appearance to a normal digital wrist watch and may serve to tell the time on the wrist through the window 7 as occasion demands.

In this case, the watch assembly B has the watch body or housing member 8 and the appendages or legs 11, 11 depressed by the retainers 1*b*, 1*c* of the mounting base 1, therefore an external force applied thereto will not detach the watch assembly B from the band A. Furthermore, the operating rods 4, 4 only project as far as a plane almost even with both sides of the arms 10, 10 of the watch assembly B, therefore the watch assembly B will never be detached by a force applied unexpectedly to the operating rods 4, 4.

On the other hand, when the band A is removed from the wrist and the heads 4*a*, 4*a* of the operating rods 4, 4 are pushed by your left-hand fingers, the stop members 4*e*, 4*e* of the operating rods 4, 4 retreat from the hole 6 of the mounting base 1, the stop projection 15 of the watch body 8 is thus released, therefore the watch assembly B will be extracted from the fitting zone 1*d* of the mounting base 1 by your right hand to detach from the band A.

Then, both the folded support members or simulated appendage legs 11, 11 are stretched or pivoted by rotating the lower thighs 11*b*, 11*b* around the shafts 13, 13 and rotating the upper thighs 11*a*, 11*a* around the shafts 12, 12 thereafter (FIGS. 6 (*a*) to (*c*)), the arms 10, 10 are then moved forward or backward as illustrated around the pins 10*a*, 10*a* (FIG. 6 (*d*)), and finally the head 9 is rotated to the front side around the pin 9*a* to turn the face simulating a robotic humanoid to the front, thus presenting a figure of a robotic humanoid familiar to infants or children (FIG. 6 (*e*)). The lower thighs 11*b*, 11*b* have openings of sufficient dimensions to encompass both their respective upper thighs 11*a*, 11*a* and the body member lower frame 14 when configured into a compact watch assembly position. Thus the pivotal movement of the arm and leg members can provide in combination with the body member an approximately rectangular peripheral storage configuration for attachment to the waistband member A.

The watch assembly B in one block may revert properly from reversing the procedures given in FIGS. 6 (*a*) to (*e*), which can be fitted on the band A again accordingly.

Then, another constitution will be conceivable such that the arms 10, 10 are provided with a hollow inner portion, a simulated hand 20 (illustrated in FIG. 6 (*e*)) is enclosed slidably in the hollow inner portion, and thus the hand 20 can be drawn out properly as occasion demands.

As described above, the toy watch according to this invention comprises a band and a watch assembly detachable from the band, the watch assembly has a watch body simulating the trunk and a head, arms and legs which are installed on the watch body, therefore when the watch assembly is installed on the band, it may serve as a normal wrist watch, and a toy robotic humanoid play will be enjoyed otherwise by detaching it from the band. Accordingly, it is expected that infants or children will find it very interesting. The toy watch may also serve for early nourishment of the children's sensitivity to time on the watch.

What is claimed is:

1. A reconfigurable toy watch assembly which is configured in a first position to simulate a compact watch assembly with an upper surface and outer perimetrical sides for mounting to a user's arm and in a second position to provide a robotic humanoid toy form comprising:

a wristband member;

a body member having an upper body surface;

means for displaying the time on the upper body surface of the body member;

a first member attached to the body member to provide a robotic humanoid head;

a pair of second members movably attached to the body member to provide respective robotic humanoid arms that are extendable from the body member in the second position, the second members and body member forming a portion of the upper watch assembly surface when the second members are moved to a position adjacent the body member so that the body member is positioned between the second members and the second members form outer perimetrical sides in the first watch assembly position, and a pair of third members movably attached to the body member to provide respective robotic humanoid legs that are extendable from the body member in the second position, the third members forming another portion of the upper watch assembly surface and an outer perimetrical side in the first watch position, the watch assembly being detachably mounted to the wristband member whereby extension of the second and third members provides an appendaged robotic humanoid configuration for play while retraction of the second and third members provides a compact watch assembly with the second and third members forming a substantial portion of the perimeter of the watch assembly and also portions of the upper watch assembly surface.

2. The invention of claim 1 further including retention means on the body member for removable attachment to the wristband member.

3. The invention of claim 1 wherein the third members are respectively divided into an upper and lower portion that are pivotally connected together, one of the portions having an inner opening configuration that encompasses the other portion when configured in a first watch assembly position.

4. The invention of claim 3 wherein the ends of the lower portions of the third members abut against each other to form the outer perimetrical side in the first watch assembly position.

5. The invention of claim 4 wherein the body member has a lower frame pivotally connected to the upper portions of the third members, the lower portions having openings of sufficient dimensions to encompass both their respective upper portions and a section of the body member lower frame when configured in a first watch assembly position.

6. The invention of claim 5 wherein the outer perimeter of the first watch assembly position provides a substantially rectangular configuration.

7. The invention of claim 6 wherein the robotic humanoid head is rotatably attached to the body member so that it has humanoid features on one side only and that side can be rotated to face towards the wristband member in a first watch assembly position.

8. The invention of claim 7 wherein the ends of the respective second members abut the respective third member lower portions in a first watch assembly position.

9. The invention of claim 8 wherein simulated hands are retractably mounted at one end of each arm of the second member.

10. The invention of claim 2 wherein the retention means includes a projecting member on the watch body member and an aperture in the retention means for receiving and releasably maintaining the watch body projecting member at the option of the user.

11. The invention of claim 1 wherein the second members and third members are pivotally mounted on the body member.

12. The invention of claim 11 wherein the pivotal movement of the arm and leg members can provide in combination with the body member, an approximately rectangular peripheral storage configuration for attachment to the wristband member.

13. A reconfigurable toy watch assembly which is configured in a first position to simulate a compact watch assembly with an upper surface and outer perimetrical sides for mounting to a user's arm and in a second position to provide a robotic humanoid toy form comprising:

a wristband member;

a body member having an upper body surface;

means for displaying the time on the upper surface of the body member;

a first member rotatably attached to the body member to provide a robotic humanoid head on at least one surface;

a pair of second members pivotally attached to the body member to provide respective robotic humanoid arms that are extendable from the body member in the second position, the second members and body member forming a portion of the upper watch assembly surface when the second members are moved to a position adjacent the body member so that the body member is positioned between the second members and the second members form outer perimetrical sides in the first watch assembly position, and a pair of third members having supporting ends pivotally attached to the body member to provide respective robotic humanoid legs that are extendable from the body member in the second position, each of the third members forming another portion of the upper watch assembly surface and an outer perimetrical side, in the first watch position, when rotated to abut their respective ends against each other adjacent the body member, the watch assembly being detachably mounted to the wristband assembly whereby extension of the second and third members provides an appendaged robotic humanoid configuration for play while retraction of the second and third members provides a compact watch assembly with the second and third members forming a substantial portion of the perimeter of the watch assembly and also a portion of the upper watch assembly surface.

14. A reconfigurable toy watch assembly which is configured in a first position to simulate a compact watch assembly with an upper surface and outer perimetrical sides for mounting to a user's arm and in a second position to provide a robotic humanoid toy form comprising:

a wristband member;

an approximately rectangular body member having an upper body surface;

means for displaying the time on the upper surface of the body member;

a first member attached to the body member to provide a robotic humanoid head;

a pair of second members movably attached to the body member to provide respective robotic humanoid arms that are extendable from the body member in the second position, the second members and body member forming a portion of the upper watch assembly surface when the second members are moved to a position adjacent the body member so that the body member is positioned between the second members and the second members form outer perimetrical sides in the first watch assembly position, and a pair of third members movably attached to the body member to provide respective robotic humanoid legs having support ends that are extendable from the body member in the second position, the third members forming another portion of the upper watch assembly surface and an outer perimetrical side, in the first watch position, when moved to abut their respective support ends against each other adjacent the body member, the watch assembly being detachably mounted to the wristband assembly whereby extension of the second and third members provides an appendaged robotic humanoid configuration for play while retraction of the second and third members provides a compact watch assembly with the second and third members forming a substantial portion of the perimeter of the watch assembly and also a portion of the upper watch assembly surface.

15. In a reconfigurable toy watch assembly which is configured in a first position to simulate a compact watch assembly with an upper surface and outer perimetrical sides for mounting to a wristband member and in a second position to provide a robotic humanoid toy form, the improvement comprising:

a body member having an upper body surface;

means for displaying the time on the upper surface of the body member;

a first member rotatably attached to the body member to provide a robotic humanoid head;

a pair of second members movably attached to the body member to provide respective robotic humanoid arms that are extendable from the body member in the second position, the second members and body member forming a portion of the upper watch assembly surface when the second members are moved to a position adjacent the body member so that the body member is positioned between the second members and the second members form outer perimetrical sides in the first watch assembly position, and a pair of third members movably attached to the body member to provide respective robotic humanoid legs that are extendable from the body member in the second position, the third members forming another portion of the upper watch assembly surface and an outer perimetrical side in the first watch position, the third members are respectively divided into an upper and lower portion that are pivotally connected together, one of the portions having an inner opening configuration that encompasses the other portion when configured in a first watch assembly position, the watch assembly being detachably mounted to the wristband member whereby extension of the second and third members provides an appendaged robotic humanoid configuration for play while retraction of the second and third members provides a compact watch assembly with the second and third members forming a substantial portion of the perimeter of the watch assembly and also a portion of the upper watch assembly surface.

16. The invention of claim 15 wherein the ends of the lower portions of the third members abut against each other to form the outer perimetrical side in the first watch assembly position.

17. The invention of claim 16 wherein the body member has a lower frame pivotally connected to the upper portions of the third members, the lower portions having openings of sufficient dimensions to encompass both their respective upper portions and a section of the body member lower frame when configured in a first watch assembly position.

18. The invention of claim 17 wherein the outer perimeter of the first watch assembly position provides a substantially rectangular configuration.

19. The invention of claim 18 wherein the robotic humanoid head is rotatably attached to the body member so that it has humanoid features on one side only and that side can be rotated to face towards the wristband member in a first watch assembly position.

20. The invention of claim 19 wherein the ends of the respective second members abut the respective third member lower portions in a first watch assembly position.

21. The invention of claim 20 wherein simulated hands are retractably mounted at one end of each of the second member arms.

22. The invention of claim 15 wherein second members and third members are pivotally mounted on the body member.

23. The invention of claim 22 wherein the pivotal movement of the arm and leg members can provide in combination with the body member an approximately rectangular peripheral storage configuration for attachment to the wristband member.

* * * * *